United States Patent [19]

Ito

[11] Patent Number: 4,492,421

[45] Date of Patent: Jan. 8, 1985

[54] LEAK-TIGHT CONNECTOR FOR ELECTRICAL CABLES

[75] Inventor: Yasunobu Ito, Aichi, Japan

[73] Assignee: Aisin Warner Kabushiki Kaisha, Anjo, Japan

[21] Appl. No.: 313,715

[22] Filed: Oct. 21, 1981

[30] Foreign Application Priority Data

Nov. 22, 1980 [JP] Japan ..... 55-148714

[51] Int. Cl.[3] ..... H01R 11/00

[52] U.S. Cl. ..... 339/59 R; 339/94 M; 339/126 RS; 339/128; 339/196 M

[58] Field of Search ..... 339/126 RS, 94 R, 94 A, 339/94 M, 143 R, 59, 128, 196 R, 196 M; 174/152 R, 23 R

[56] References Cited

U.S. PATENT DOCUMENTS

| | | | |
|---|---|---|---|
| 2,115,495 | 4/1938 | Mapelsden | 339/126 RS |
| 2,958,842 | 11/1960 | Schaefer | 339/94 M |
| 3,308,316 | 3/1967 | Pfahl | 339/94 R |
| 3,495,028 | 2/1970 | Tutthill | 339/126 RS |
| 3,718,887 | 2/1973 | Soloman et al. | 339/143 R |
| 3,818,420 | 6/1974 | Barr | 339/94 R |

*Primary Examiner*—Eugene F. Desmond
*Assistant Examiner*—David L. Pirlot
*Attorney, Agent, or Firm*—Blum, Kaplan, Friedman, Silberman & Beran

[57] ABSTRACT

A sealing and connecting device for cables used in a hydraulic control system of an automatic transmission includes a connecting element to be fixed into a hole formed in a housing in which the hydraulic control system is installed. The connecting element is formed substantially in cylindrical shape and provides plural passages and an internal cylindrical space, wherein a rubber bushing is inserted having the same number of through holes as the number of the above passages. Cables having ends electrically connected to a solenoid valve in the hydraulic control system are inserted through the holes in the rubber bushing, and the free ends of the cable are electrically connected within the above passages to other cables which are electrically connected outside the housing. A synthetic resin filler is poured into the surroundings of the cable connection and into the passages where it sets. The connecting element is then pushed into the housing hole and fixed by a flange which projects outward radially and by radially projecting elastic tabs.

18 Claims, 8 Drawing Figures

LEAK-TIGHT CONNECTOR FOR ELECTRICAL CABLES

BACKGROUND OF THE INVENTION

This invention relates generally to a connector for electrical cables and more particularly to a leak-tight connector for use in the wall of a housing containing electrical components submerged in a fluid as in a hydraulic control system of an automatic transmission.

In a hydraulic control system of an automatic transmission, an electrical device which operates while immersed in fluid, such as a solenoid valve, is installed in a housing of the hydraulic control system, and an electronic control system which generates a control signal for the electrical device is provided outside of the housing.

To prevent the fluid used in the hydraulic control system from leaking through, that is, along the electrical cable or cables which connect between the electric device in the housing and the electronic control system outside of the housing, a sealing device including a rubber bushing is fitted in a hole formed in the housing. The cable or cables are inserted through the rubber bushing, and then are drawn out to the exterior from the inside of the housing while relying on the rubber bushing for prevention of leakage. However, such a conventional sealing device has many drawbacks as follows.

The temperature of the fluid used in a hydraulic control system of an automatic transmission becomes very high during operation of the automatic transmission. Therefore, a cable or cables are used which consist of a bundle of electric wires coated cylindrically over the outer periphery with tetrafluoroethylene, which is known under the trademark Teflon. Such a coated cable is referred to hereinafter as Teflon cable.

However, Teflon cable is expensive so when Teflon cable is used for the portion of the cable on the external side of the housing, the cost is increased. In such a construction, moreover, because a single Teflon cable connects between the interior and exterior of the housing, the fluid in the housing leaks to the exterior of the housing due to capillarity through the clearance between the electric wires in the Teflon cable and the clearance between those wires and the cylindrical Teflon coating.

What is needed is a connector through a housing containing fluids in which electrical components are immersed, which is leak-tight, simple to install, and economical in application.

SUMMARY OF THE INVENTION

Generally speaking, in accordance with the invention, a liquid-tight connector especially suitable for the hydraulic control system of an automatic transmission is provided. A first cable connected to an electrical device immersed in fluid in a hydraulic control system, as in an automatic transmission, and a second cable connected to a control device located externally of the housing of the hydraulic control system are interconnected by electrically connecting the respective electrical wires in the interior of a tubular portion of the sealing device. The interior of the tubular portion of the sealing device, including the surroundings of the connection between cables is filled with a resin filler. Thereby, not only is an electrical connection between the first and second cables achieved but also leakage of fluid from the sealed portion is prevented. The cable has a special coating, for example, Teflon, for use inside the housing where it makes contact with the fluid which operates at high temperatures. Externally of the housing conventional cables which are less expensive than Teflon are used. Thus, economy is achieved without sacrifice of performance.

According to the present invention, there is provided a sealing and connecting device for cables in a hydraulic control system. The hydraulic control system comprises a housing in which the hydraulic control system is installed, an electrical device mounted in the hydraulic control system and operative in fluid used in the system, a control device mounted outside the housing for generating control signals inputted to the electrical device, a hole formed in the housing for inserting therethrough a cable or cables which electrically connect between the electric device and the control device.

The sealing and connecting device includes a connecting element molded from a material impervious to oil, resistant to heat and having elasticity. The connecting element is provided on its outer periphery with a cylindrical portion and there is at least one passage through the interior of the connecting element. Also included are means for fixing the connecting element to the hole in the housing in a liquid-tight manner, and at least a first cable comprising a bundle of electric wires having a cylindrical shape and coated on the external surface thereof with a synthetic resin impervious to oil and resistant to heat. The first cable is connected at one end to the electrical device within the liquid filled housing. A second cable comprised of a bundle of electrical wires coated over with rubber or a resin connects at one end to an external control device. The other ends of the first and second cables are connected within the passage of the connecting element of the sealing and connecting device. Then the connected cables are coated at the connection and the passage wherein the connections are made is filled with a synthetic resin filler to form a liquid tight joint between the wires in the filler and the connector.

Accordingly, it is an object of this invention to provide an improved connector for electrical cables in a hydraulic control system which prevents leakage of transmission fluid.

Another object of this invention is to provide an improved connector for electrical cables in a hydraulic control system which provides for easy connection of an internal cable with an external cable in the connector.

A further object of this invention is to provide an improved connector for electrical cables in a hydraulic control system which is easy to insert and retain in the housing of the hydraulic control system.

Still another object of this invention is to provide an improved connector for electrical cables in a hydraulic control system which allows for different types of cables internally and externally so as to provide a more economical construction.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
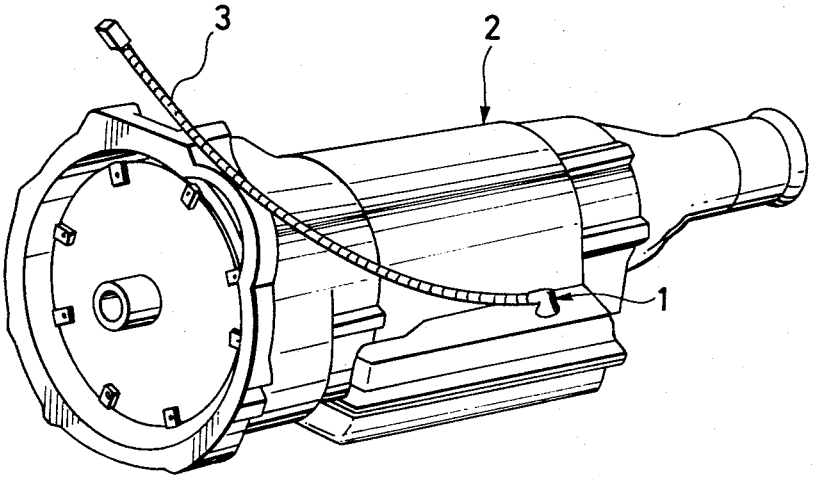
FIG. 1 is a perspective view of an automatic transmission suitable for the application thereto of a connector for electrical cables in a hydraulic control system in accordance with this invention.
Figure 2:
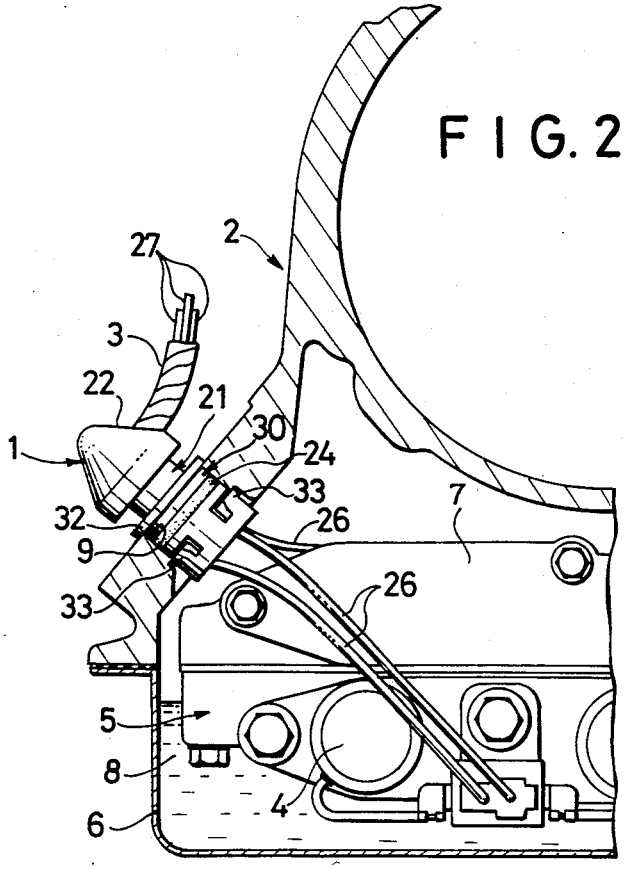
FIG. 2 is a sectional view of a hydraulic control system having a liquid-tight connector for electrical cables in accordance with this invention.

With reference to the Figures, and initially to FIGS. 1 and 2, a connecting device 1 is fixed in a hole formed in a housing 2 of an automatic transmission in which a hydraulic control system 5 is installed. A sheath 3 of cables is located on the exterior of the housing 2 and is connected to the connecting device 1.

As best seen in FIG. 2 an oil pan 6 and a casing 7 of the hydraulic control system 5 are fixed to the housing 2 and a solenoid valve 4 of the control system 5 is immersed in a fluid 8. The connecting device 1 includes a connecting element 21 which is inserted into the hole 9 formed in the housing 2, and is fixed to the housing 2 in a liquid-tight manner.

As described more fully hereinafter, cables 26 within the housing 2 are connected at one end electrically to the solenoid valve 4. Cables 27 located externally of the housing 2 have one end electrically connected to an electronic control system (not shown) which generates control signals for operation of the solenoid valve 4. The cables 27 are bundled within the sheath 3, and the other ends of the cables 26,27 are electrically connected together within passages formed in the connecting element 21. Those passages in the connecting element 21 and the space surrounding the cable connections are filled in a liquid-tight manner with a synthetic resin filler.

The cable 26 comprises a bundle of electric wires coated over the exterior surface thereof with a cylindrical layer of tetrafluoroethylene resin (Teflon) which is impervious to heat and to oil as occur in the automatic transmission housing 2. The cable 27 comprises a bundle of electric wires having a cylindrical coating of polyethylene over the external surface thereof.

Figure 3:
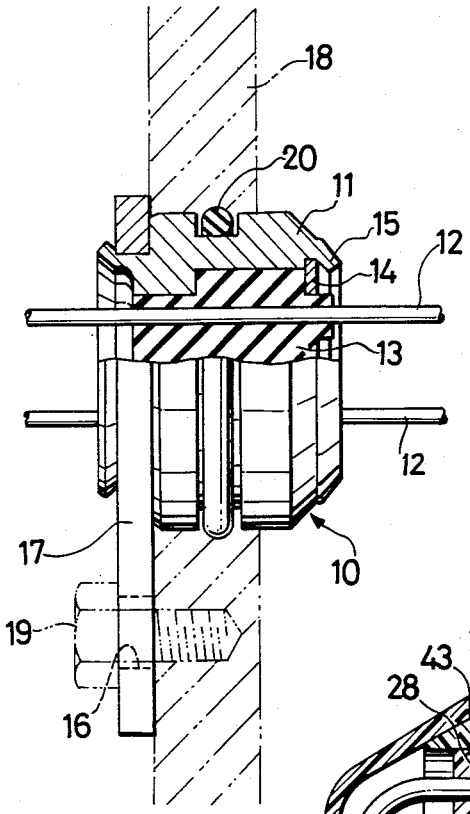
FIG. 3 PRIOR ART
FIG. 3 is a partially sectioned side view of a sealing device of the prior art.

In a prior art sealing device of this type (FIG. 3) a rubber bushing 13 is mounted within a casing 11 machined from an aluminum block. The rubber bushing 13 is held by a plate 14 and the plate is fixed to the casing 11 by staking an end portion 15 of the casing 11 around its circumference. Teflon coated cables 12 pass through the rubber bushing 13.

A plate 17 having a bolt hole 16 therethrough, is secured to the casing 11 and by means of the plate 17, the sealing device 10 is fixed to a casing 18 of an automatic transmission using a bolt 19. An O-ring 20 is mounted in a circumferential groove on the surface of the casing 11 of the sealing device 10 for maintaining the joint surface between the casing 18 and the sealing device 10 in a liquid-tight manner.

The prior art sealing device 10 has the following drawbacks. First, because the cable inserted through the sealing device 10 is immersed in fluid in the interior of the automatic transmission, and because the temperature of the hydraulic fluid becomes high while the automatic transmission is in operation, a Teflon coated cable which is impervious to both oil and heat should be used. Heretofore however, such Teflon cable has also been used for the portion of the cable which is located outside of the automatic transmission even though this portion of the cable is not immersed in the fluid or subject to such elevated temperatures. It is not desirable from the aspect of cost to use this expensive Teflon coated cable unnecessarily in the external portion.

Secondly, the casing of the sealing device 10 is costly since it is machined from an aluminum block. Third, the sealing device 10 is inferior in its mounting properties since it is mounted with a bolt to the casing of the automatic transmission. Fourth, because the cable which is intended for sealing is a single Teflon cable extending from the interior of the automatic transmission to the exterior, fluid leaks occur due to the capillarity through the clearances within the cable so the intended sealing function is lost.

Figure 4:
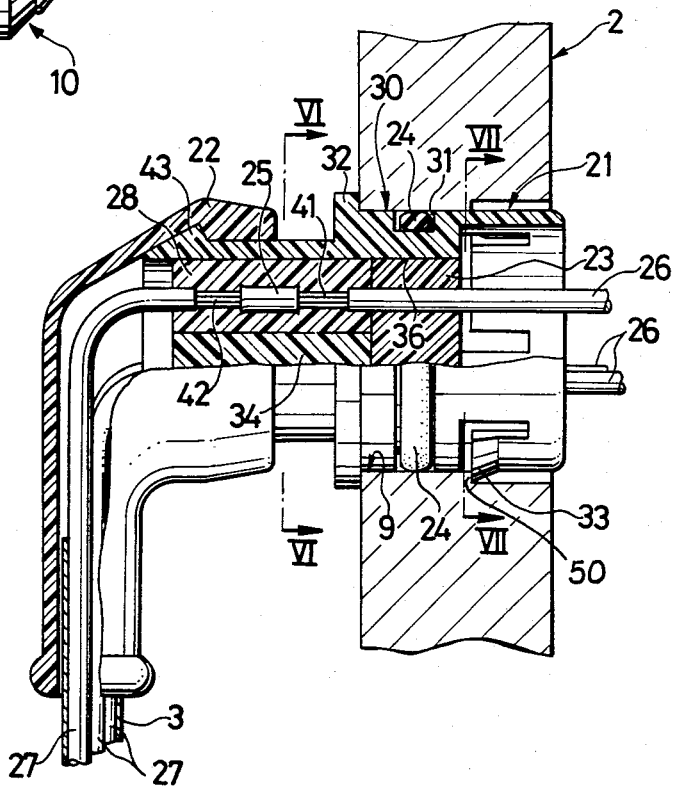
FIG. 4 is a partially sectioned side view of a connector for electrical cables in a hydraulic control system in accordance with this invention.
Figure 5:
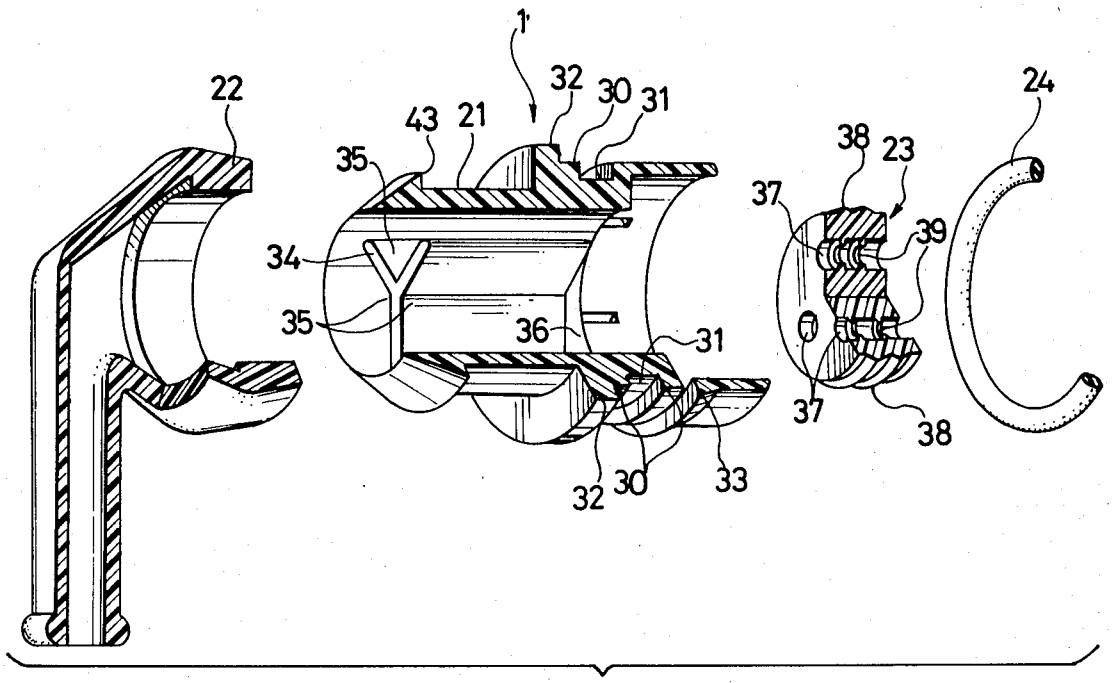
FIG. 5 is an exploded perspective view with parts partially in section of the connector for electrical cables of FIG. 4.
Figure 7:
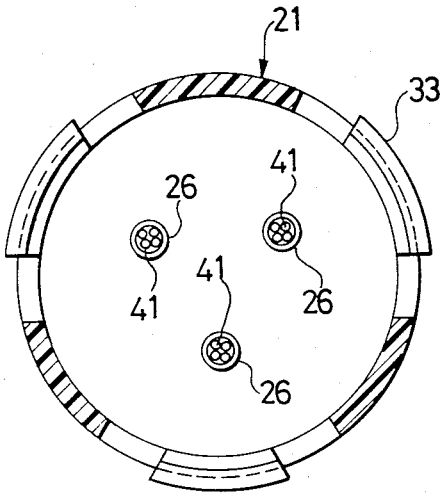
FIG. 7 is a sectional view taken along the line VII—VII of FIG. 4.
Figure 6:
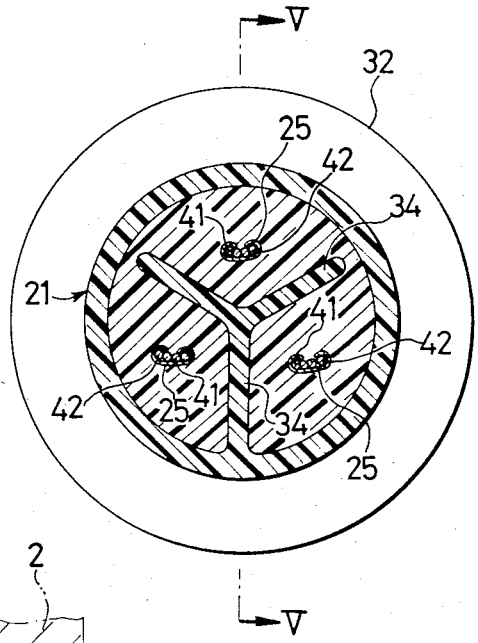
FIG. 6 is a sectional view taken along the line VI—VI of FIG. 4.

FIG. 4 illustrates in detail a section of a connector for electrical cables in a hydraulic control system in accordance with this invention. FIG. 5 is an exploded view, partly in section, and FIGS. 6 and 7 are sectional views as indicated in FIG. 4. The connecting element 21 is molded substantially in a cylindrical form from a synthetic resin material, such as 66 nylon, which has superior properties and is impervious both to oil and heat, and is elastic. The central portion of the connecting element 21 has a cylindrical outer wall portion 30 which fits tightly into the circular hole 9 of the housing 2. At one end of the outer cylindrical wall portion 30 and integral therewith extends a radially projecting flange 32.

The other end of the cylindrical outer wall portion 30 is formed with a plurality of tabs 33 which are integral with the element 21 but partially separated by means of U-shaped notches. The free end of each tab 33 projects radially outward beyond the surface of the cylindrical portion 30. With such a construction, when the connecting element 21 is inserted from its free end, that is, with the tabs 33 entering first, into the hole 9 of the housing 2, the tabs 33 are forced radially inwardly in an elastic manner. This permits insertion of that free end into the hole 9. When the flange 32 comes into contact with the external surface of the housing 2, tabs snap radially outward by virtue of their elasticity so as to engage a shoulder 50 in the hole 9. Thus, the connecting element 21 is fixed to the housing 2 and is not readily pulled out.

The outer wall portion 30 is tightly fitted into the hole 9. To make the liquid-tightness of the connection more perfect between the connecting element 21 and the inner wall of the hole 9, an annular groove 31 is formed circumferentially in the cylindrical outer wall portion 30, and an O-ring 24 is mounted in the annular groove 31.

As best seen in FIGS. 4, 5, and 6, the interior of the connecting element 21 is substantially an open cylinder except that a partition wall 34 extends in an axial direction through a major part of the connecting element 21. The partition wall 34 extends from the outside of the housing 2, that is, from the left in FIG. 4, and has a Y-shaped section as viewed (FIG. 6) in a plane perpendicular to the axial direction of the connecting element 21. Thereby a portion of the inner space of the connecting element 21 is divided into three passages 35 (FIG. 5) with the center of the Y-shape being approximately at the center of the inner cylindrical opening of the connecting element 21. The number of passages 35 corresponds to the number of cables 27 connected to the solenoid valve 4. As the number of cables connecting to the electrical device, which operates in the fluid, increases, the number of passages 35 in the partition 34 is increased correspondingly. The remaining interior space of the connecting element 21, not occupied by the partition 34, forms a cylindrical open space 36.

A substantially cylindrical bushing 23 having three axially parallel through holes 37 is formed of an elastic material such as a natural or synthetic rubber. On the outer periphery of the rubber bushing 23, and on the inner walls of the through holes 37, annular ridge portions 38,39 respectively are formed integrally (FIG. 5). The cables 26 which are electrically connected at one end to the solenoid valve 4, are inserted through the through holes 37 of the bushing 23. The cables 27 which are electrically connected at one end to the control device (not shown) which generates a control signal for the solenoid valve 4, are inserted through the passages 35 in the connecting element 21. The rubber bushing 23 is aligned in the connecting element 21 such that the through holes 37 line up with the passages 35 whereby the free ends of the cables 26,27 are opposed to each other in the passages 35, one of each cable 26,27 being in each passage 35.

The outer coating of the cables is stripped (FIG. 4) to allow the electrical conductive wires 41,42 within the cables 26,27 respectively to be exposed. The exposed ends are connected together by a joint terminal 25 which is formed of a strip of electrically conductive metal material. That is, a strip of metal sheet is formed in advance into a C-shape (FIG. 6). The stripped wires 41,42 rest within the C-shape and then both end portions of the C-shape are staked to mechanically join together and electrically connect the electric wires 41,42.

After completion of the electrical connection by using the joint terminal 25, the rubber bushing 23 is inserted into the cylindrical space 36 within the connecting element 21. The annular ridge portions 38 formed on the outer periphery of the rubber bushing 23, and the annular ridge portions 39 formed on the inner walls of the through holes 37 of the rubber bushing 23 improve the liquid-tightness between the connecting element 21 and the rubber bushing 23 and between the rubber bushing 23 and the cables 26, respectively.

Then, a synthetic resin filler 28 which is superior in electrical insulation characteristics and impervious to heat and oil, for example, an epoxy or silicone resin, is flowed into the passages 35 of the connecting element 21 from the open end where the cables 27 enter. The resin fills the passages 35 and surrounds the electrical connections 24,41,42 which have been inserted in the passages 35 as described above. Thereby, the interiors of the passages 35 containing the connections are filled with a filler resin 28 and the connections are also covered by the filler 28.

On the end of the connecting element 21 through which the cables 27 are inserted from the exterior of the housing 2, an annular triangular projection 43 extends radially outward. A rubber cover 22 over the end of the cable sheath 3 is retained by the projection 43 (FIG. 4).

To connect the connecting device 1 to the housing 2, the cables 26 which are connected at one end thereof to the solenoid valve 4, are inserted through the through holes 37 of the rubber bushing 23. The cables 27, electrically connected at one end to the electronic control device (not shown), are bundled with the sheath 3 and inserted through the rubber cover 22. Then, the cables 27 are passed respectively through passages 35 in the connecting element 21, and the cables 26,27 electrically corresponding to each other are connected by the joint terminal 25. Then, the rubber bushing 23 is fitted in the cylindrical space 36 of the connecting element 21 and the synthetic resin filler 21 is flowed into the passages 35. Thereafter, the O-ring 24 is fitted in the annular groove 31 of the connecting element 21 and the rubber cover 22 is fitted over the connecting element 21 to engage the annular protrusion 43, Finally, the connecting element 21 is inserted and fixed into the hole 9 of the housing 2 by engagement of the tabs 33 with the shoulder 50 in the hole 9, and by the fit between the cylindrical surface 30 and the hole 9.

The cable 26 having a Teflon coating is used only in the portion immersed in the fluid within the housing 2. In this construction, the fluid may pass through the cable 26 and reach the connecting element 21 due to the capillarity, but its leakage to the exterior is prevented since the the passages 35 in the connecting element 21 where the electrical connections of the cables 26,27 are present, are filled and closed with the synthetic resin filler 28. The clearance between the electrical wires 41,42 is also filled with the resin filler 28, whereby fluid is prevented from out leakage through the clearance between the electric wires 41,42 due to capillarity. Furthermore, leakage of fluid through the connecting element 21 is prevented by the existence of the rubber bushing 23 between the cables 26 and the connecting element 21.

Figure 8:
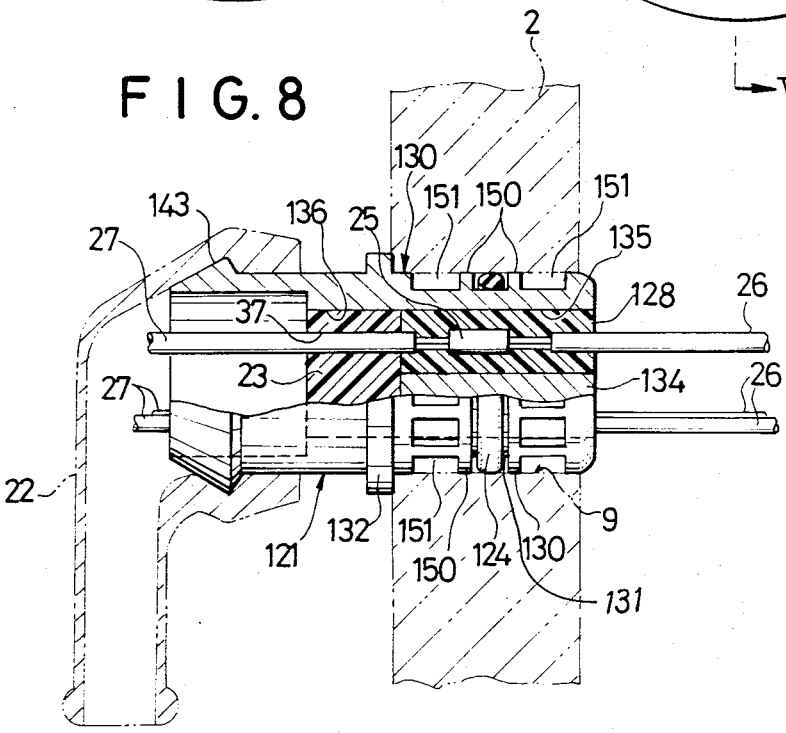
FIG. 8 is a view similar to FIG. 4 of an alternative embodiment of a connector for electrical cables in a hydraulic control system in accordance with this invention.

FIG. 8 illustrates an alternative embodiment of a connector for electrical cables in a hydraulic control system in accordance with this invention. A connecting element 121 is substantially cylindrical in shape and is formed from a synthetic resin material such as 66 nylon which is impervious in its properties to oil and to heat. The material also has elastic properties. A radially projecting flange 132 extends from a central portion along the axial length of the connecting element 121. On one side of the flange 132, that is, within the wall of the housing 2, there is a cylindrical wall portion 130 which fits tightly in the circular hole 9 of the housing 2. At the far end of the connecting member 121 on the other side of the flange 132, a projection 143 extends radially from the surface for engagement with the rubber cover 22 as described in the embodiment above. An annular groove 131 is formed around the cylindrical outer wall portion 130 at approximately the center thereof. An O-ring 124 fits in the groove 131 to maintain a liquid-tight joint between the hole 9 in the housing 2 and the cylindrical outer wall portion 130. The surface of the remaining portion of the cylindrical outer wall portion 130 includes many grooves 151 having circumferential ribs 150 between the grooves 151. The lattice of ribs 150 exerts an elastic force on the wall of the hole 9 in the housing 2, and thereby the cylindrical outer wall portion 130 is tightly fitted in the hole 9.

In the interior of the connecting element 121, is a partition wall 134 having a Y-shaped section as described above. The partition 134 extends along the length of the connecting member 121 to correspond with the cylindrical portion 130, and divides the inner space of the connecting element 121 into three substantially symmetrical passages 135 within the connecting member 121.

A rubber bushing 23, substantially of the same shape as shown in FIG. 4, is inserted into the connecting member 121 in the completed assembly. The cables 26, electrically connected at one end thereof to the solenoid valve 4 in the housing 2, are inserted respectively through the passages 135 in the connecting element 121. The ends of the cables 27 are inserted through through holes 37 of the rubber bushing 23 and are electrically connected by the joint terminal 25 to the ends of the cables 26 outside the passages 135.

Thereafter, the rubber bushing 23 is inserted in a cylindrical space 136 in the interior of the connecting element 121, and the cables 26,27 are moved so that the joint terminal 25 is positioned approximately centrally in each of the passages 135. Then, the passages 135 are filled with a synthetic resin filler 128 having superior electrical insulation properties and also being impervious to heat and oil. An epoxy or silicone resin is suitable to such an application. Thereby, the surroundings of the connection of the cables 26,27 by the joint terminal 25 as well as the passages 135 are filled and sealed. After the synthetic resin filler 128 has been hardened, the connecting element 121 is tightly fitted and fixed into the hole 9 of the housing 2.

As compared with the prior art sealing device described above, the connector for electrical cables in a hydraulic control system in accordance with this invention affords the following advantages. First, the connection element is inexpensive since it is molded from a synthetic resin rather than machined from aluminum. Second, only the cable which is immersed in the fluid within the housing need have the expensive Teflon coating. The cable used outside the housing may be a cable having a less expensive, for examples, polyethylene or rubber coating. Third, the connecting device is fixed to the housing merely by pushing it into a hole formed in the housing. Fourth, the connection between electric wires of the cables by the joint terminal is surrounded with a synthetic resin filler to eliminate the clearance between the cable coating and the electric wires as well as the clearance between the electric wires. Thereby, leakage of fluid by capillary action is prevented.

Although, the connection between the wires within the connecting element 21,121 is illustrated and described using a C-type clip 25,125 which is staked to the wires, it should be apparent that many other types of connectors between the two wires can be used within the passages 35,135 prior to filling these passages with the resin.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A sealed connector for cables passing through a wall of a housing, a hole formed through the wall of said housing, comprising;

a connecting element, said connecting element having at least on its outer periphery, a portion for mating with said hole, said connecting element having at least one passage through the interior thereof;

means for fixing said connecting element in said hole of said housing;

means for connecting together at least one first and at least one second cable, said at least one first cable and at least one second cable each comprising a bundle of electrically conductive wires and a coating over the outer periphery of said bundle of wires, and defining clearances within the coating and between the wires, the coating being stripped from respective ends of the first and second cables which are to be attached to each other, said means for connecting said cables comprising a joint terminal adapted to connect the respective ends of said first and second cables;

said connecting element being adapted to receive a respective end of each of said at least one first and at least one second cable from opposite sides of said wall of said housing in one of said passages through the interior of said connecting element; and means for sealing the outer periphery of the bundle of wires and the clearances of at least one of said at least first cable and said at least one second cable in the region where the coating is stripped, said sealing means permeating said clearances and coating said periphery of the bundle of wires with a filler therein in a liquid tight manner, fluid being prevented from leaking out of said housing through the clearances between said electrically conductive wires due to capillary action in the clearances.

2. A sealed connector as claimed in claim 1, wherein said connecting element is formed from a material which is highly heat-resistant and impervious to oil penetration.

3. A sealed connector as claimed in claim 1, wherein said hole is circular and said portion of said connecting element for mating with said hole is also circular.

4. A sealed connector as claimed in claim 1, wherein said connecting element is formed from a material having a high resistance to oil penetration and to high temperature, the number of said passages in the interior of said connecting element being equal to the number of said first and second cables, one first cable and one second cable being connected in each said passage.

5. A sealed conector as claimed in claim 4, wherein said periphery of the bundle of wires and clearances where the coating is stripped off are sealed and each of said passages is filled with a synthetic resin, said synthetic resin being the product of filling said passage with a fluid resin, said resin setting in said passage.

6. A sealed connector as claimed in claim 1, wherein said first cable is coated with a synthetic resin, said synthetic resin being impervious to oil and highly heat resistant, said second cable being coated with one of a rubber and a resin, said coating not being adapted to be impervious to oil nor to resist high temperatures.

7. A sealed connector as claimed in claim 1, wherein said periphery of the bundle of wires and clearances in the region where the coating is stripped off are filled and said one passage is filled with a synthetic resin, said synthetic resin being the product of filling said passage with a fluid resin, said resin setting in said passage.

8. A sealed connector as claimed in claim 7, wherein said cables have a coating over the outer periphery thereof for said seal.

9. A sealed connector as claimed in claim 7, wherein said joint terminal is formed of an electrically conductive metal strip in the shape of a C, at least a portion of the respective ends of said electrically conductive wires where the coating is stripped off being cradled by said C-shaped joint terminal, such joint terminal being staked, tightly connecting together said first and second cables at said exposed ends.

10. A sealed connector as claimed in claim 9, wherein said filler is an electrical insulator.

11. A sealed connector as claimed in claim 9, and further comprising a partition, said partition being located within said connecting element and dividing said interior thereof into at least two passages, each said passage containing one first and one second cable for connection therein.

12. A sealed connector as claimed in claim 9, and further comprising a rubber cover, said rubber cover and an end portion of said connecting element projecting exteriorly of said housing being adapted for interconnection, said cover protecting said at least one second cable.

13. A sealed connector as claimed in claim 9, wherein said means for fixing said connecting element in said hole of said housing in a leak-tight manner includes a groove in said outer periphery of said connecting element portion for mating with said hole, and an O-ring fitted in said groove for leak-proof contact with said groove and the inner periphery of said housing hole.

14. A sealed connector as claimed in claim 9, and further comprising an elastic bushing, said bushing being adapted to fit in the interior of said connection element with a liquid-tight seal between said connecting element and said elastic bushing, said elastic bushing including passages therethrough, the number of said passages corresponding with the number of said passages in said connecting element, said at least one first cable passing through a passage of said elastic bushing and a passage of said connecting element, said elastic bushing making a liquid-tight seal with said first cable passing therethrough.

15. A sealed connector as claimed in claim 14, wherein said elastic bushing is formed of rubber.

16. A sealed connector as claimed in claim 14, wherein said means for fixing said connecting element in said hole of said housing in a leak-tight manner includes a groove in said outer periphery of said connecting element portion for mating with said hole, and an O-ring fitted in said groove for leak-proof contact with said groove and the inner periphery of said housing hole.

17. A sealed connector as claimed in claim 9, and further comprising a plurality of tabs, said tabs being integrally formed on said external periphery of said connecting element, said tabs having an elastic quality, said tabs being adapted to compress together radially when said connecting element is pushed into said hole in said housing wall, said tabs being adapted to expand radially when said connecting element is seated in said housing hole, said tabs being adapted to engage a surface of said housing by said radial expansion, said expanded tabs resisting the withdrawal of said connecting element from said housing hole.

18. A sealed connector as claimed in claim 17, wherein said means for fixing said connecting element in said hole of said housing in a leak-tight manner includes a groove in said outer periphery of said connecting element portion for mating with said hole, and an O-ring fitted in said groove for leak-proof contact with said groove and the inner periphery of said housing hole.

* * * * *